US007069871B2

(12) United States Patent
Widell et al.

(10) Patent No.: US 7,069,871 B2
(45) Date of Patent: Jul. 4, 2006

(54) EMBROIDERY OF PATTERNS

(75) Inventors: Kerstin Widell, Huskvarna (SE); Anders Andersson, Vaggeryd (SE)

(73) Assignee: VSM Group AB, Huskvarna (SE)

( * ) Notice: Subject to any disclaimer, the term of this patent is extended or adjusted under 35 U.S.C. 154(b) by 236 days.

(21) Appl. No.: 10/400,696

(22) Filed: Mar. 28, 2003

(65) Prior Publication Data

US 2003/0183148 A1 Oct. 2, 2003

(30) Foreign Application Priority Data

Mar. 28, 2002 (SE) ..... 0200959

(51) Int. Cl.
*D05C 5/02* (2006.01)

(52) U.S. Cl. ..... 112/475.19; 112/102.5; 700/138

(58) Field of Classification Search ..... 112/102.5, 112/262.3, 266.1, 453, 454, 456, 458, 470.06, 112/475.19; 700/138
See application file for complete search history.

(56) References Cited

U.S. PATENT DOCUMENTS 4,352,334 A 10/1982 Childs et al.
4,622,907 A * 11/1986 Kimura ..... 112/102.5
4,742,786 A 5/1988 Hashimoto et al.
4,841,891 A * 6/1989 Hashimoto et al. .... 112/475.05
5,343,401 A * 8/1994 Goldberg et al. ..... 700/138
6,202,001 B1 3/2001 Muto

* cited by examiner

*Primary Examiner*—John J. Calvert
*Assistant Examiner*—Brian Kauffman
(74) *Attorney, Agent, or Firm*—Venable LLP; Eric J. Franklin

(57) ABSTRACT

A method of embroidering a pattern by means of a processor-controlled sewing machine, the method comprising the following steps: the fabric that is to be embroidered is placed in the required position in relation to a threaded needle on the sewing machine, a number of embroidery elements having pre-programmed embroideries are provided, each embroidery element is provided with a starting point and an end point for an embroidery on a corresponding physical embroidery element, a directional change associated with the end point is assigned to the embroidery element, in embroidering a sequence of physical embroidery elements by means of the sewing machine a succeeding physical embroidery element is rotated corresponding to the directional change in the preceding physical embroidery element, an embroidery having any desired number of physical embroidery elements in sequence is performed by the sewing machine according to the sequence of selected embroidery elements. The invention also comprises the embroidery elements and the method of designing these to form the pattern which the sewing machine is to embroider.

18 Claims, 1 Drawing Sheet

EMBROIDERY OF PATTERNS

TECHNICAL FIELD

The present invention relates to a method of embroidering patterns by means of a processor-controlled sewing machine, in which a number of predefined embroidery elements are embroidered in successive sequence, the invention further relating to the embroidery elements themselves, which are characterized in that information on the starting point and direction of a succeeding embroidery element is associated with the preceding embroidery element.

PRIOR ART

In embroidering a fabric using the technology currently available it is possible to use ready designed embroidery elements which are stored in a memory, either in the sewing machine or an external memory unit. Such embroidery elements can be combined and programmed to succeed one another in order to generate a desired pattern. Examples of the combination of embroidery elements are given in the document U.S. Pat. No. 4,352,334, which discloses a method of combining embroidery elements, in this case embroidered letters, so that these follow a predefined curve. By specifying certain data, such as the radius of the curve, for example, the machine then embroiders a sequence of embroidery elements along the predefined curve, in which the embroidery elements are slanted in relation to one another in order to follow the curve described. The information for the sewing machine memory on the reciprocal relationship of the embroidery elements is in this case supplied externally by user-input and is not derived from data associated with the embroidery elements themselves. Another document U.S. Pat. No. 6,202,001 describes a method of storing data on a sewing pattern in embroidery blocks, which recur cyclically in a sequence so as to produce a desired embroidery pattern.

SUMMARY OF THE INVENTION

According to one aspect of the invention a method is provided for embroidering patterns by means of a processor-controlled sewing machine. The method consists of:

- the fabric that is to be embroidered is placed in the required position in relation to a threaded needle on the sewing machine,
- a number of embroidery elements in the form of software products having pre-programmed embroideries are provided, each embroidery element being provided with a starting point and an end point together with a directional change associated with the end point for an embroidery of a physical embroidery element corresponding to the embroidery element,
- an embroidery is pre-determined or is successively selected during the stitching according to a pattern that is created from stored data in any desired number of embroidery elements in a sequence,
- in embroidering a sequence of physical embroidery elements, a succeeding physical embroidery element is rotated by an angle equal to the sum of the directional changes of the preceding physical embroidery elements,
- embroidery of the pattern is performed by the sewing machine according to the sequence of selected embroidery elements.

According to a further aspect of the invention, embroidery elements are produced, which consist of a software product for use in an embroidery performed on a processor-controlled sewing machine, in which the embroidery is performed as the embroidering of a sequence of successive physical embroidery elements, the embroidery elements being characterized in that they are provided with a starting point and an end point for a programmed embroidery for each embroidery element stored in the memory. Furthermore, a directional change is associated with the end point for each embroidery element.

The embroidery elements are stored as data files on any desired storage medium, each separate embroidery element comprising data with information on each individual stitch in an embroidery that is to be performed by the sewing machine in order to create a physical embroidery element from the data relating to the embroidery of the physical embroidery element. This means that a corresponding data file, here simply referred to as the embroidery element, is linked to each physical embroidery element that can be embroidered by the sewing machine.

Data for each individual embroidery element can be reproduced as a graphic representation of the embroidery element including the outlines thereof and includes graphic representation of its embroidery on a display, which may be integrated with the sewing machine. On the display any desired embroidery element can be retrieved from the storage medium and shown as a named graphic representation of the embroidery element. For the sake of simplicity, each such graphic representation of an embroidery element is here referred to as a graphics module. By freely selecting graphics modules and joining a number of these together to form a sequence on the display using the graphic representations, a pattern for the desired embroidery is created. The sequence of selected graphics modules is stored in a memory as a selected sequence of embroidery elements.

According to the method an embroidery element can be set to produce a directional change for the next physical embroidery element in a sequence, or set to produce a displacement of the end point in relation to the starting point without directional change (see FIG. 4 or 3 and 6 respectively, for example). The graphic representations of each embroidery element, that is to say the graphics modules where a number of these are linked together in a sequence on a display, also forcibly bring about corresponding directional changes or displacements. An embroidery element can be provided with further attributes such as size, for example. The data relating to the configuration of a physical embroidery element, in the form of starting point, end point and further attributes are stored in the memory and associated with each embroidery element in the stored sequence of selected embroidery elements.

By combining embroidery elements of different shape and assigning attributes to the embroidery elements, such as different sizes, for example, and through the further facility for lateral inversion of the embroidery elements, enclosed frames or continuous borders of any shape can be created by stitching the physical embroidery elements according to the sequence.

The directional change, also known as the element angle, for a certain embroidery element can be set to any angle, but in order to limit the number of elements the angles 0°, 30°, 45° and 90° may suitably be used.

The flexibility can be further increased by using a particular attribute to displace the starting point for a physical embroidery element by a desired distance in any direction in relation to the end point of the preceding physical embroidery element.

The embroideries contained in a library of physical embroidery elements contemplated, stored as software products, may have any appearance and number of colors. However, the starting point and end point should preferably lie on one of the outlines of a physical embroidery element, so that any physical embroidery element can be linked to a preceding one without any overlap occurring. The embroidery elements are stored in the sewing machine memory or can be stored to the sewing machine memory from any desired memory medium. Angled physical embroidery elements can be executed as curves with different radii. Using such physical embroidery elements it is then possible to produce oval or circular embroidered frames.

The advantages in executing the parts of the desired embroidery as physical embroidery elements using information on the physical embroidery element linked to each embroidery element include:

- ease of use, in the same way as text that is assembled from embroidered letter elements,
- ease of producing borders and enclosed patterns with perfect matching between different elements in the pattern or border,
- Color sorting can be implemented as for multicolor fonts, so that the number of thread changes is minimized.

Color sorting for the sequence of selected embroidery elements means that each color to more than one embroidery element is indexed, the stitching of the embroidery for the entire embroidery sequence being performed in order such that all embroidery elements in the sequence are embroidered with a certain color having the same index, where upon a change of thread is carried through. All embroidery elements in the sequence using a thread of a color according to a second color index are then similarly embroidered. Thread changes to other color are then undertaken in turn with corresponding stitching of the entire embroidery for the selected thread and color.

DESCRIPTION OF EMBODIMENTS

A number of examples of embodiments of the present invention will be demonstrated with reference to the figures attached.

Embroideries are performed in a known manner on a processor-controlled sewing machine in that the fabric that is to be embroidered is clamped in a frame, which can be controlled by stepping motors so that in an xy-plane it moves in an x-direction or a y-direction in relation to the threaded needle of the sewing machine. The pattern which the embroidery is intended to form is programmed into a memory that is read by the processor, which accordingly controls the stepping motors in the x-direction and the y-direction in such a way that the stitching data stored in the memory for obtaining the programmed embroidery can be accomplished by moving the frame in the xy plane, so that the needle sews the stitching on the fabric in co-ordinates according to the stored embroidery data.

The term embroidery element is hereinafter used for the software product in the form of the data file which contains information that is required to enable the sewing machine processor to embroider a corresponding physical embroidery on a fabric or to enable the processor to show corresponding embroidery elements graphically on a display, the stored form of the embroidery elements and embroidery patterns being illustrated for the user for the design of embroidery patterns. Where it is readily apparent that it is the graphic or physical representation of an embroidery element which is intended, the term embroidery element is also used for these representations.

Figure 1:
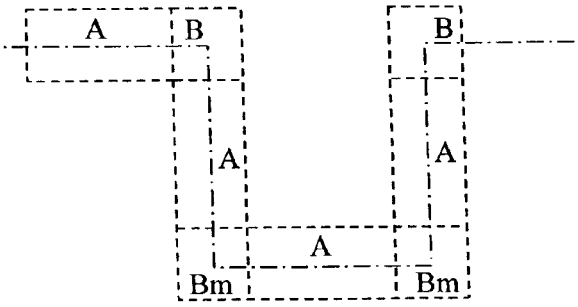
FIG. 1 shows an example of a sequence of physical embroidery elements or associated graphics modules arranged in a square wave pattern.
Figure 2:
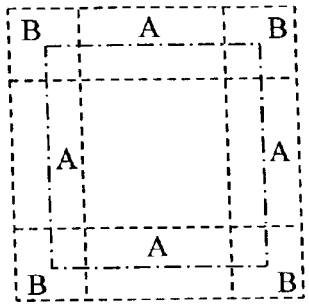
FIG. 2 illustrates a further sequence of physical embroidery elements or associated graphics modules arranged so that they form a frame.

FIG. 1 shows a sequence of graphic representations of embroidery elements which are combined and programmed to succeed one another, so that together they form a desired embroidery pattern. Each embroidery element is selected from a collection of predefined embroidery elements that are stored in the sewing machine memory or can be stored in the sewing machine memory. Another such sequence of graphic representations of embroidery elements is shown in FIG. 2. Each individual embroidery element has an embroidery associated therewith, here referred to as an element pattern, which is known and stored in a memory, in which the information on each individual stitch of the embroidery that is to be executed physically on the fabric is programmed and stored in a memory, which is associated with the embroidery element. By combining embroidery elements which have various forms in their graphic and physical counterpart and by giving each embroidery element attributes, such as size, inversion of the graphic and physical embroidery element etc, it is possible to create enclosed frames or continuous borders of arbitrary shape and with any combination of element patterns.

Figure 3:
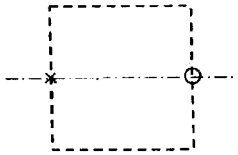
FIG. 3 shows a physical embroidery element or associated graphics module with element angle of 0°, that is to say that each succeeding physical embroidery element or associated graphics module is not rotated further.
Figure 4:
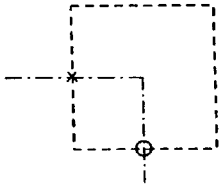
FIG. 4 illustrates a physical embroidery element or associated graphics module in which the element angle is 90°.
Figure 5:
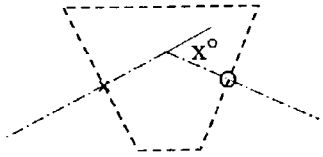
FIG. 5 illustrates a physical embroidery element or associated graphics module in which the outlines thereof are not rectangular and in which the element angle is an arbitrary x°.

The embroidery elements are characterized in that they are assigned a starting point, an end point and a directional change. The directional change, here referred to as the element angle, may be arbitrary but in order to limit the number of element variants the element angle may be suitably limited to a few angles, such as 0°, 30°, 45° or 90°, for example. Examples of such embroidery elements in graphic form are shown with a 0° element in FIG. 3 and a 90° element in FIG. 4. An embroidery element that contains data with arbitrary element angle x° for a graphic-physical counterpart is shown in FIG. 5.

By combining graphic or physical representations of the embroidery elements, the rotation of such an element is always equal to the sum of the element angles of preceding elements taking into account their respective attributes. If graphic-physical embroidery elements with the element angles 0°, 90°, 0°, 90°, 0°, 90°, 0° and 90° are assembled into a sequence, these elements will form a square frame. An example of such a frame is shown in FIG. 2, in which graphic-physical representations of the embroidery elements A and B are combined to form such a sequence. With a sequence of embroidery elements shown as graphic or physical representation combined according to the sequence of the element angles 0°, 90°, 0°, −90°, 0°, −90°, 0°, 90° a border of the square wave type is instead formed. An example of such a border is shown in FIG. 1, in which the embroidery elements are A, B, A, Bm, A, Bm, A, B. Embroidery elements with element angle −90° in principle need not be provided in the memory, since existing embroidery elements with a certain element angle in their representations can be laterally inverted as left or right-oriented embroidery elements in relation to the embroidery direction. Examples of such lateral inversion are the Bm elements, which are lateral inversions of the B elements.

Figure 6:
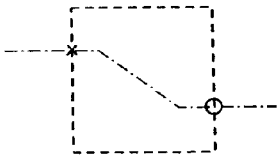
FIG. 6 shows a further example of a physical embroidery element or associated graphics module with element angle of 0°.

Embroidery elements can also be formed with the element angle 0°, so that the end point of the physical element pattern is displaced in relation to the starting point in both the x and y direction, as is shown in FIG. 6.

Figure 7:
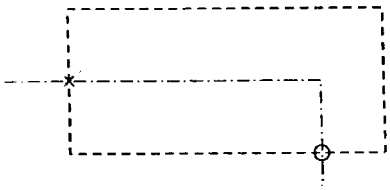
FIG. 7 shows a physical embroidery element or associated graphics module in which the element angle is 90° and in which the end point of the embroidery is located asymmetrically on an outline of the physical embroidery element or the associated graphics module.
Figure 8:
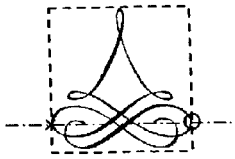
FIG. 8 illustrates an example of an embroidery of a physical embroidery element or associated graphics module with an element angle of 0°.

Yet another example of an embroidery element variant is shown in its graphic/physical representation in FIG. 7, in which the element is asymmetrical, that is to say as in the case shown, in which the embroidery of the embroidery element has its end point asymmetrically located on an outline of the embroidery element.

As stated, the embroidery elements are characterized in that they have a defined starting point and a defined end point for the embroidery of each embroidery element. In the figures the starting point is marked by a cross (X), whilst the end point is marked by a circle (O).

In order to allow embroidery elements to be linked together in sequences according to the aspect of the invention, each embroidery element must contain information on directional change for the embroidery element, and end co-ordinates relative to the starting point of the embroidery element.

In the embroidery element data, information on the end co-ordinate may either be given separately or be represented by the co-ordinates for the last stitch of the physical embroidery element (in the case of absolute stitch information), or by the sum of all the stitches forming part of the embroidery of the physical embroidery element (in the case of relative stitch information).

A sequence of embroidery elements can be created if the machine, in addition to first memories for the identity of the embroidery elements arranged in the sequence and their change parameters, contains second memories for storing the resulting absolute end co-ordinate and resulting sum of element angles for each embroidery element forming part of the sequence, taking change parameters into account. These second memories are zeroed when starting to input a new sequence.

According to the example of an embodiment, an embroidery sequence is stored as follows:

1. A desired embroidery element is selected from the accessible memory. The embroidery element selected is displayed graphically, shown with the shape and embroidery pattern on the sewing machine screen (or other associated display), with the starting point according to a register for absolute end co-ordinate and rotated according to the resulting sum of element angles taking into account the change parameters for all preceding embroidery elements in the sequence. For the first element in a sequence this means a starting point in the middle of the stitch surface and without rotation. The identity of the element is stored in the memory.
2. Any change parameters can be added to the relevant embroidery element by the user. The change parameters, which are also stored in the memory, may be size, displacement, rotation and lateral inversion, for example.
3. The resulting absolute end co-ordinate and resulting rotation are calculated from previously stored values and values for the elements in question, adjusted to take account of change parameters. The new absolute values are stored and represent the starting co-ordinate and angle of rotation for any succeeding element.
4. Steps 1–3 are repeated for each new embroidery element in the sequence.

The invention claimed si:

1. A method of embroidering a stitched pattern with a processor-controlled sewing machine, the method comprising:

placing fabric that is to be embroidered in a position in relation to a threaded needle on the sewing machine;

providing a plurality of embroidery elements having pre-programmed embroideries, each embroidery element comprising a starting point and an end point corresponding to a start point and end point of a corresponding physical embroidery element, each embroidery element further comprising a directional change by a predetermined angle in a succeeding embroidery element;

creating a pattern from a sequence of the embroidery elements prior to or during embroidery of the pattern, wherein during creation of the pattern embroidery elements are added to the sequence, wherein each added embroidery element is rotated at the predetermined angle in relation to a preceding embroidery element in the sequence;

rotating each physical embroidery element by an angle equal to a sum of the directional changes of all preceding physical embroidery elements in embroidering the pattern with the sewing machine; and embroidering the pattern with the sewing machine according to the sequence of embroidery elements.

2. The method according to claim 1, wherein the position of a physical embroidery element in relation to a preceding physical embroidery element in the sequence is arranged so that the starting point of the physical embroidery element is set to coincide with the end point of the preceding element.

3. The method according to claim 1, wherein the position of a physical embroidery element in relation to a preceding physical embroidery element in the sequence is arranged so that the starting point of a physical embroidery element is displaced by a desired distance in any direction in relation to the end point of the preceding physical embroidery element.

4. The method according to claim 1, wherein the embroidery element is designed in order to produce a displacement of the end point relative to the starting point without directional change.

5. The method according to claim 1, wherein the embroidery element contains data for producing a directional change by a predetermined angle in a succeeding embroidery element in the sequence during stitching of the succeeding embroidery element in the sequence or when the succeeding embroidery element is shown graphically on a display.

6. The method according to claim 1, wherein embroidery elements with different element angles are combined in a sequence, which in stitching forms a border or frame or some other coherent pattern of embroideries created by means of data from the embroidery elements.

7. An embroidery element comprising a software product for use in the method according to claim 1, stored on a data storage medium and comprising:

a program readable by the sewing machine processor to enable the processor to control the sewing machine in order to execute an embroidery of a physical embroidery element according to data stored in the program, wherein the physical embroidery element has a defined starting point and a defined end point for the embroidery written into the program and wherein the program of the embroidery element comprises data for producing a directional change by a predetermined angle in a succeeding embroidery element.

8. The embroidery element according to claim 7, wherein a displacement of the end point relative to the starting point with no directional change is assigned to the embroidery of the physical embroidery element, data relating to the displacement being written into the program for the embroidery element.

9. The embroidery element according to claim 7, wherein the directional change is represented by an arbitrary angle.

10. The embroidery element according to claim 7, wherein the directional change is represented by any of the angles 0°, 30°, 45° and 90°.

11. The embroidery element according to claim 7, wherein the starting point and end point are located on the outlines of the physical embroidery element.

12. The embroidery element according to claim 7, wherein data for the embroidery element relating to its pre-programmed embroidery, starting point, end point, directional change and data relating to specific attributes are stored in a memory file associated with the embroidery element, the data file being stored in the sewing machine internal memory or stored to the sewing machine internal memory from an external memory unit.

13. The embroidery element according to claim 7, wherein borders of the physical embroidery element are straight or curved.

14. The embroidery element according to claim 7, wherein the outlines of the physical embroidery element form a parallelogram, a triangle or a trapezium.

15. The method according to claim 1, further comprising:

indexing colors in the embroidery;

assigning a same index to colors common to more than one embroidery element; and performing stitching of the embroidery with color sorting, wherein all embroidery elements having a first color index are embroidered first using a first thread according to the embroidery sequence, embroidery elements having a second color index are then embroidered with a second thread according to the embroidery sequence and in a corresponding way for threads with a third and higher color index.

16. A method of designing a pattern for an embroidery for a processor-controlled sewing machine, the method comprising:

providing a set of embroidery elements having pre-programmed embroideries, each embroidery element being provided with a starting point, and end point and a directional change of a predetermined angle in a succeeding embroidery element;

representing at least one subset of embroidery elements graphically in shape and with associated embroidery pattern on a screen;

selecting an embroidery element from the subset and linked to previously selected embroidery elements on the same or a different screen;

in linking together a sequence of graphic embroidery elements by means of the sewing machine, a succeeding graphic embroidery element is rotated by an angle equal to the sum of the directional changes of the preceding graphic embroidery elements;

an embroidery is predetermined or successively selected according to a pattern created from any desired number of embroidery elements in sequence; and storing the selected sequence of embroidery elements in a memory.

17. The method according to claim 16, wherein the position of a graphic embroidery element in relation to a preceding graphic embroidery element in the sequence is arranged so that the starting point of a graphic embroidery element is set to coincide with the end point of the preceding element.

18. The method according to claim 16, wherein the position of a graphic embroidery element in relation to a preceding graphic embroidery element in the sequence is arranged so that the starting point of a graphic embroidery element is displaced by a desired distance in any direction in relation to the end point of the preceding graphic embroidery element.

* * * * *